United States Patent [19]

Willig et al.

[11] 4,371,044

[45] Feb. 1, 1983

[54] SIMULTANEOUS MULTIGUN HIGH DENSITY MULTIPHASE PERFORATING UNIT

[75] Inventors: Roy L. Willig, Lafayette; Edward J. LeBlanc, III, Youngsville; Harold Airhart, Sr., Lafayette, all of La.

[73] Assignee: CRC Wireline, Inc., Grand Prairie, Tex.

[21] Appl. No.: 180,449

[22] Filed: Aug. 22, 1980

[51] Int. Cl.[3] ..... E21B 43/116

[52] U.S. Cl. ..... 175/4.6; 102/310; 102/319; 166/55

[58] Field of Search ..... 175/4.51–4.59, 175/4.6; 166/297, 55, 55.1; 102/310, 319

[56] References Cited

U.S. PATENT DOCUMENTS

| | | | |
|---|---|---|---|
| 2,593,866 | 4/1952 | Evans | 175/4.57 |
| 2,733,657 | 8/1956 | Bryant et al. | 175/4.6 |
| 2,833,214 | 5/1958 | Spencer | 175/4.6 |
| 2,889,774 | 6/1959 | Allen | 175/4.52 |
| 3,415,321 | 12/1968 | Venghiahis | 102/310 |
| 3,565,188 | 2/1971 | Hakala | 175/4.6 |
| 3,734,018 | 5/1973 | Gillinghan | 102/319 |
| 3,739,723 | 6/1973 | Hakala | 102/20 |
| 4,179,991 | 12/1979 | Echols et al. | 102/21.6 |

*Primary Examiner*—William F. Pate, III

*Attorney, Agent, or Firm*—Richards, Harris & Medlock

[57] ABSTRACT

A perforating unit for high density, multiphase well perforating operations having a plurality of elongate cylindrical perforating gun barrels whose firing axes are at predetermined angles one relative to the other. A multiport top sub secures the upper ends of the barrels with the barrels parallel to each other. A cablehead on the top sub provides for support. A multiport bottom sub secures the lower ends of the barrels. A circuit in the cablehead extends through the cablehead and into the unit for use in detonation of explosive charges to be received therein.

11 Claims, 8 Drawing Figures

SIMULTANEOUS MULTIGUN HIGH DENSITY MULTIPHASE PERFORATING UNIT

TECHNICAL FIELD

This invention relates to perforating guns used in oil wells, and more particularly, to the provision of a multigun high density multiphase perforator structure.

BACKGROUND ART

In perforation of oil well casing at depths corresponding to the location of oil bearing formations, reusable guns have been used of the type illustrated and described in U.S. Pat. No. 3,565,188 to John R. Hakala. Expendable guns have also been utilized which are generally of the type shown in U.S. Pat. No. 3,739,723 to John R. Hakala. The present invention involves the use of expendable guns and, more particularly, to a perforating gun structure involving two or more guns for multiphase perforations, i.e., perforations at a given level in two or more controlled direction relationships.

DISCLOSURE OF INVENTION

The present invention relates to a high density multigun positive phase perforating unit, wherein a plurality of expendable cylindrical perforating gun barrels are each adapted to receive an insert carrying shaped charge for positioning an array of charges within each barrel. The axes of the charges in a given barrel all lie on a common firing plane with an explosive cord extending from the bottom of each barrel and interconnecting all charges on a given insert.

A multiport top sub secures the upper ends of the barrels, with the barrels in parallel relation to each other and firing planes thereof oriented at equal angles from one another. A cable support structure is provided on the top sub with connections for a firing circuit to pass therethrough. A multiport bottom sub secures the bottom ends of the barrels with means for accommodating a firing cap which is detonable upon energization of an electrical circuit including said connections thereby to initiate detonation of the explosive cord.

High density positive phase perforating is achieved using the above gun by grouping two or more standard perforating guns in equally spaced relation with specially designed adaptor subs which determine the phase of the shots. The specially designed lower sub permits capping procedures necessary to fire the guns simultaneously.

High density positive phase perforating of oil wells has significant operating time reduction over conventional operations. All shots over a given depth interval of an oil well are fired simultaneously on one trip. This eliminates random phasing (directions) of shots in high density situations. High densities may be considered to be of the order of twelve (12) holes per foot of well depth. The present invention provides for a positive phase control.

Further, because all shots over a given interval are fired simultaneously, the chance of shot overlap, irregular shot spacing, and inconsistent pattern density are eliminated. Thus, control spacing in high density perforation is a significant contribution of the present invention.

BRIEF DESCRIPTION OF DRAWINGS

For a more complete understanding of the invention and for further description thereof, reference may be had of the following detailed description taken in conjunction with the accompanying drawings in which.

DETAILED DESCRIPTION

Figure 1:
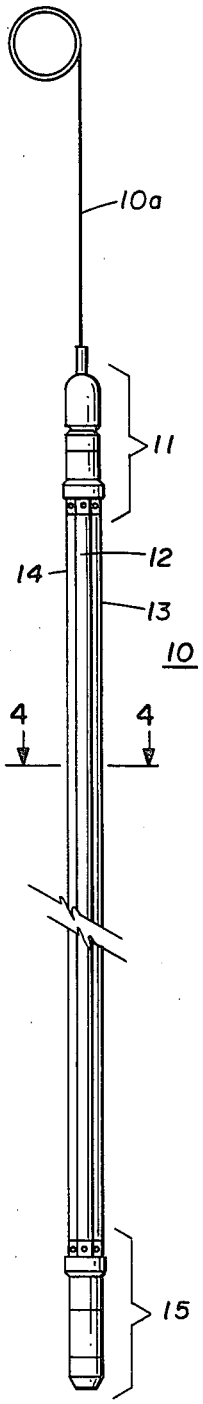
FIG. 1 is an elevational view of one embodiment of the invention.

Referring now to FIG. 1, a multiphase high density perforating gun 10 has been illustrated as supported by a cable 10*a* whereby the unit 10 is adapted to be lowered on the earth's surface into an oil well to a desired depth at which point the oil well is to be perforated.

Unit 10 includes a cablehead 11 which is coupled at its lower end to each of three expendable perforated gun barrels 12–14. Barrels 12–14 are secured at their lower ends to bottom sub 15.

Figure 2:
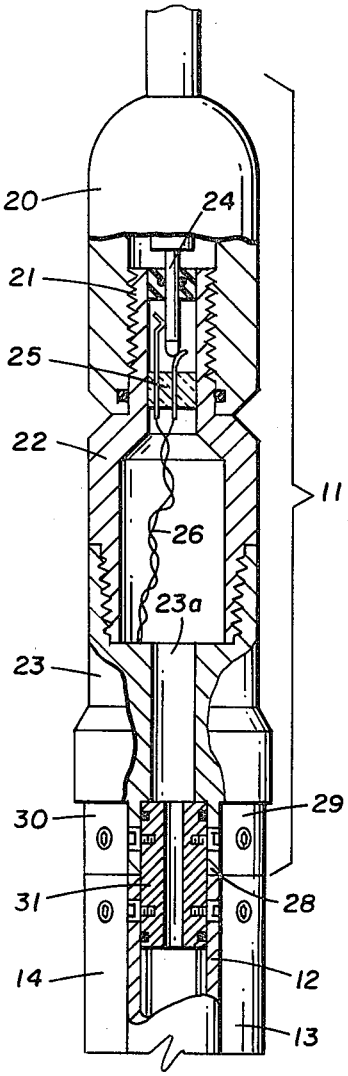
FIG. 2 is a detailed cross-sectional view of the upper end of the gun of FIG. 1.

As illustrated in FIG. 2, cablehead 11 includes a cablehead unit 20 which has internal threads which mate with a threaded male member 21 which extends upward and forms a part of a second head unit 22. Head unit 22 threadedly engages the upper end of an adaptor unit 23. The lower end of adaptor unit 23 is provided with structure for mating with the upper ends of each of the three gun barrels 12–14.

It will be noted that the upper end of the cablehead 20 is provided with an electrical two-conductor bayonet plug 24 which extends into a bore in the upper end of the threaded male unit 21. A receptacle structure 25 mounted in unit 21 is adapted to receive and make contact with the two conductor elements of the plug 24 thereby to extend a firing circuit from cable 10*a* into the perforating gun 10. A pair of conductors 26 extend from the receptacle 25. Intermediate element 22 is hollow providing for passage therethrough of the conductors 26. Adaptor 23 is provided with three ports extending therethrough such as the port 23*a*. The three ports are arrayed at equal angles from one another and at equal distances from the center axis of the adaptor 23. Coaxial with the port 23*a* is a tubular extension 28. Barrel 12 is secured to extension 28 by means of an internal coupling unit 31. In a similar manner, an extension 29 is provided for connecting to and supporting the second gun barrel 13. Similarly, an extension 30 is provided for coupling to and supporting the third gun barrel 14.

The insert 31 may be of the type illustrated and described in U.S. Pat. No. 4,179,991 which issued Dec. 25, 1979.

The conductors 26 in the form shown in FIG. 2 extend through the port in adaptor 23 associated with the extension 30 and barrel 14.

Figure 3:
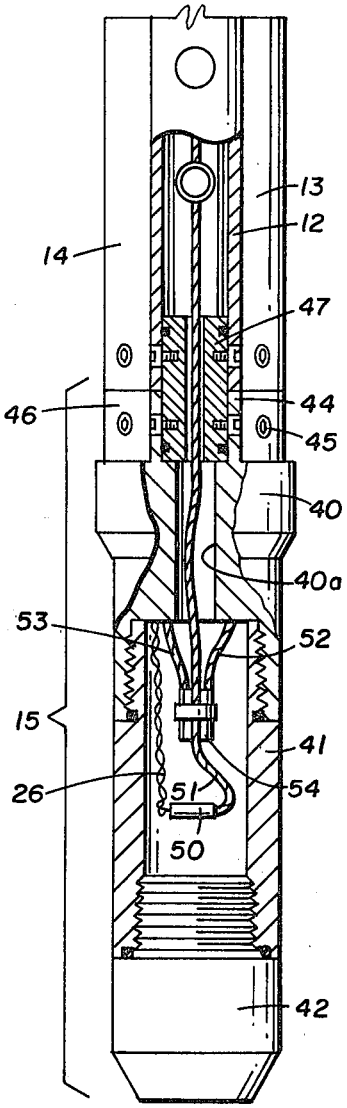
FIG. 3 is a detailed view of the lower end of the gun of FIG. 1.

While not showing, the conductors 26 extend the full length of barrel 14 and lead to a detonating cap in the bottom sub shown in FIG. 3. As shown in FIG. 3, the bottom sub comprises an adaptor 40 which has three ports, only one of which, the port 40, is shown. The three ports, including port 40, are arranged at equal distances from the axis of the bottom sub 15 and are spaced at equal angles around the axis. The adaptor 40 is threadedly connected to a sub unit 41 which is in the form of a hollow cylinder, the lower end of which is threaded and receives a bottom plug 42.

The upper end of adaptor 40 is provided with three extensions 44, 45 and 46. Extension 44 serves to connect to the lower end of gun 12. The extension 45 serves to connect to the lower end of gun 13 and the extension 46 serves to connect to the end of gun 14. The couplings between the extensions 44–46 to guns 12–14, respectively, are made by way of coupling units such as unit 47 which is shown cooperating with extension 44 and barrel 12. Conductors 26 pass down through gun barrel 14 and emerge into the hollow central portion of sub unit 41.

A detonating cap 50 is connected to the lower end of conductors 26 and is adapted to be detonated when the circuit comprising conductors 26 is suitably energized. A length of primacord 51 is inserted into the end of cap 50 and extends upward through port 40*a*, through the coupler 47 and then upward through the length of barrel 12. Similarly, a second length of primacord 52 extends upwardly through the port associated with gun barrel 13 and thence upward through barrel 13. A third length of primacord 53 extends upward through the port associated with gun barrel 14 and thence upward through the length of barrel 14.

A detonator booster unit 54 is coupled to an intermediate point on cord 51 and to the lower ends of cords 52 and 53. When the cap 50 is detonated, the detonation proceeds along the length of the cord 51. As it passes booster 54, it causes cords 52 and 53 also to be detonated so that the detonation wave travels simultaneously up the lengths of the three gun barrels 12–14.

Figure 4:
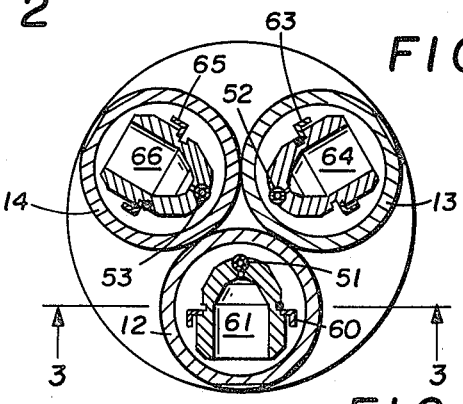
FIG. 4 is a sectional view taken along lines 4—4 of FIG. 1.

FIG. 4 illustrates the relationship between barrels 12–14. They are positioned tangent to one another and each accommodate a plurality of explosive charges, of the shape charge variety, wherein the charges are individually loaded onto a channel-shaped insert. More particularly, the preferred insert 60 is shown extending upward through the barrel 12 of FIG. 4. The plural charges, such as the charge 61 are mounted on the channel 60 at selected spaced intervals, for example, four inches apart. Similarly, the channel 63 is mounted in gun barrel 13 and supports a plurality of charges such as the charge 64. In a similar manner, a channel 65 extends upwardly through the gun barrel 14 and supports the plurality of charges such as the charge 66.

Figure 5:
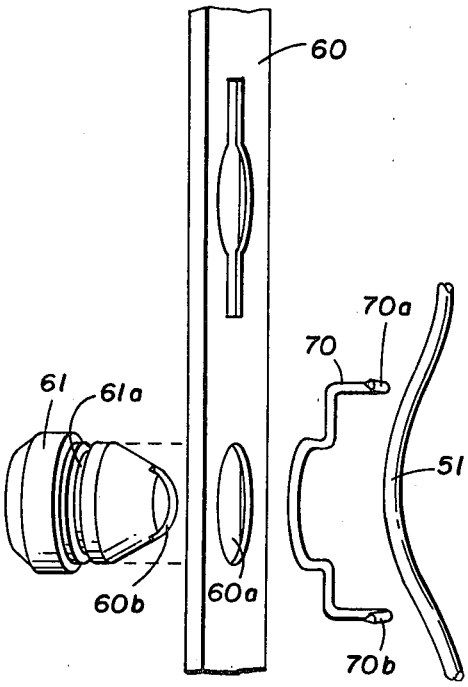
FIG. 5 illustrates a preferred form of charge carrying inserts utilized with the present invention.
Figure 6:
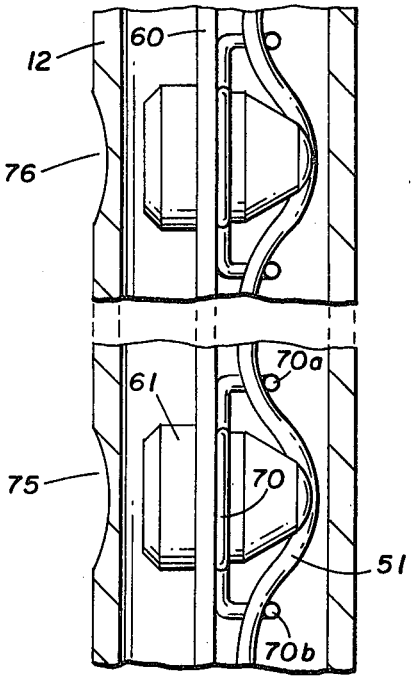
FIG. 6 is an assembly view of a portion of one of the guns of FIG. 1 showing the charge carrying insert and the detonating primacord associated therewith.

The manner in which the charges may be suitably mounted is illustrated in FIGS. 5 and 6. FIG. 5 is an exploded view showing a portion of the channel 60 and one associated charge 61. The channel 60 has holes such as the hole 60*a* extending through the channel web. The shaped charge 61 is then inserted through the hole 60*a*. A preformed wire clamp unit 70 then is positioned to encircle the shaped charge 61 and to mate in an annular groove, thereby to secure the charge 61 to the channel 60. The preformed wire clamp 70 has opposite ends formed as hooks, 70*a* and 70*b*. Primacord length 51 is then threaded underneath the hooks 70*a* and 70*b*, with a portion of cord 51 midway between the hook portions lying in a transverse groove or slot 60*b* in the cone-shaped end of the charge 61.

In FIG. 6, the channel 60 is shown with shaped charge 61 secured thereto by wire clamp 70 with the primacord 51 forced into the groove in the end of shaped charge 61 by threading the same underneath the hooks 70*a* and 70*b*. A second shaped charge is shown immediately above shaped charge 61 and is similarly mounted in the channel 60. It will be noted that the walls of the gun barrel 12 are ground thin at points 75 and 76, the thinned points being aligned with the axes of the shaped charges 61.

Figure 7:
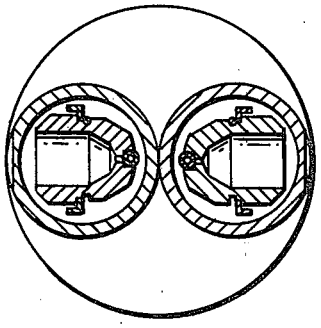
FIG. 7 illustrates a two-phase gun involving the present invention.
Figure 8:
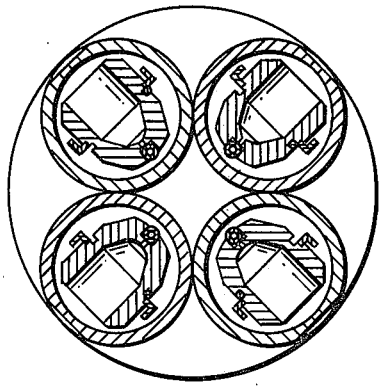
FIG. 8 illustrates a four-phase gun involving the present invention.

In the embodiment described, three guns 12–14 have been utilized so that the phase of the charges is fixed at 120° from each other. In the illustration shown in FIG. 7, a two-barrel gun is shown with the phase of the charges of 180° from each other. In FIG. 8, a four-barrel gun is shown with the phase of the charges 90° from each other. In each case, the head and sub diameter is such that the gun barrels when tangent to each other are also tangent to the head and sub.

The triple perforating gun of FIGS. 1–6 with shaped charges located every three inches along its length will produce twelve (12) holes per foot, providing such capability on each trip into the well. This serves to reduce rig time by two-thirds ($\frac{2}{3}$) without loss of penetration or reduction of hole size. With the gun barrel twenty (20) feet long, 240 holes can be produced per run. It will be recognized that shot densities of from 1 to 12 holes per foot are available on a positive 120° phasing, producing uniform patterns inside the casing and reducing the possible casing splitting or damage.

The triple gun unit of FIGS. 1–6 is suitable for use in 7 inch casing. The four gun unit of FIG. 8 will be suitable for use in $7\frac{5}{8}$ inch casing.

Having described the invention in connection with the foregoing embodiment, it is understood that the invention is not limited to the specific embodiments disclosed, but it is intended to embrace modifications and rearrangements and/or substitutions of parts or elements as fall within the spirit and scope of the appended claims.

What is claimed is:

1. A perforating unit for high density, multiphase well perforating operations which comprises:

(a) a plurality of elongated cylindrical perforating gun barrels having firing axes at predetermined angles one relative to the other and adapted to receive an array of charges;

(b) a multiport top sub securing together the upper ends of said barrels, with said barrels parallel to each other;

(c) a cablehead on said top sub; and (d) a multiport bottom sub securing together the lower ends of said barrels and including means to detonate said charges.

2. The combination set forth in claim 1 in which said subs support said barrels with the firing axis at equal angles.

3. The combination set forth in claim 1 in which two barrels are supported with said firing planes at 180° one relative to the other.

4. The combination set forth in claim 1 in which three barrels are supported with said firing planes at 120° one relative to the other.

5. The combination set forth in claim 1 in which four barrels are supported with said firing planes at 90° one relative to the other.

6. The combination set forth in claim 1 wherein means including circuit means in said cablehead extend a firing circuit through said cablehead and into said unit for use in detonation of explosive charges to be received therein.

7. The combination set forth in claim 1 wherein said barrels are parallel and tangent.

8. A high density, multiphase well perforating unit which comprises:

(a) a plurality of cylindrical perforating gun barrels, each adapted to receive and position an array of charges within each barrel, with axes of said charges directed along a firing plane;

(b) a multiport top sub securing together the upper ends of said barrels, with said barrels parallel to each other and with firing planes thereof oriented at predetermined angles one from the other;

(c) a cablehead on said top sub; and (d) a multiport bottom sub securing together the lower ends of said barrels and including means to detonate said charges.

9. A high density, multiphase well perforating unit which comprises:

(a) a plurality of expendible cylindrical perforating gun barrels for receiving and positioning arrays of charges with axes thereof in a given barrel directed along the same firing plane;

(b) a multiport top sub securing the upper ends of said barrels, with said barrels parallel to each other and with firing planes thereof oriented at predetermined angles from the other;

(c) cable support structure on said top sub having connections for a firing circuit to pass therethrough; and (d) a multiport bottom sub securing together the lower ends of said barrels adapted to accommodate firing means operable in response to electrical energy applied by way of said connections to initiate detonation of said charges.

10. A high density, multiphase well perforating unit which comprises:

(a) a plurality of cylindrical perforating gun barrels, each adapted to receive an array of shaped charges for positioning said charges within each said barrel;

(b) a separate explosive cord extending from the bottom of each barrel and interconnecting all charges in a given array;

(c) a multiport top sub securing together the upper ends of said barrels, with said barrels parallel to each other and having firing planes thereof oriented at predetermined angles one relative to the other;

(d) a cablehead on said top sub having connections for a firing circuit to pass therethrough; and (e) a multiport bottom sub securing together the lower ends of said barrels with means to detonate said explosive cord.

11. A high density, multiphase well perforating unit which comprises:

(a) a plurality of expendible cylindrical perforating gun barrels, each adapted to receive an array of shaped charges for positioning said charges within each said barrel, with the axes for said charges in a given barrel all substantially in the same firing plane and with a separate explosive cord extending from the bottom of each barrel and interconnecting all charges of a given array;

(b) a multiport top sub securing together the upper ends of said barrels, with said barrels parallel to each other and with firing planes thereof oriented at predetermined angles one from the other;

(c) wireline support structure on said top sub having connections for a firing circuit to pass therethrough; and (d) a multiport bottom sub securing together the lower ends of said barrels with means to accommodate a firing cap which is detonable upon energization of an electrical circuit including said connections thereby to initiate detonation of said explosive cord.

* * * * *